United States Patent [19]

Buschulte

[11] 4,364,725

[45] Dec. 21, 1982

[54] BLUE-FLAME OIL BURNER

[75] Inventor: Winfried Buschulte, Celle, Fed. Rep. of Germany

[73] Assignee: Deutsche Forschungs- und Versuchsanstalt fur Luft- und Raumfahrt e.V., Cologne, Fed. Rep. of Germany

[21] Appl. No.: 328,004

[22] Filed: Dec. 7, 1981

Related U.S. Application Data

[63] Continuation of Ser. No. 859,716, Dec. 12, 1977, abandoned.

[30] Foreign Application Priority Data

Jan. 8, 1977 [DE] Fed. Rep. of Germany ..... 2700671

[51] Int. Cl.[3] ..... F23D 13/40

[52] U.S. Cl. ..... 431/116; 431/62; 431/265; 431/353

[58] Field of Search ..... 431/19, 20, 62, 90, 431/254, 264, 265, 353

[56] References Cited

U.S. PATENT DOCUMENTS

| | | | |
|---|---|---|---|
| 2,499,207 | 2/1950 | Wolfersperger | 431/265 |
| 2,512,919 | 6/1950 | Collins et al. | 431/62 |
| 2,539,165 | 1/1951 | Saha | 431/116 |
| 2,790,868 | 4/1957 | McClary | 431/90 |
| 2,859,807 | 11/1958 | Newman et al. | 431/90 |
| 2,881,790 | 4/1959 | McCarty | 431/19 |
| 2,979,124 | 4/1961 | Kirk | 431/90 |
| 2,986,209 | 5/1961 | Mittendorf | 431/62 |
| 3,074,469 | 1/1963 | Babbitt et al. | 431/353 |
| 3,221,799 | 12/1965 | Hamelink et al. | 431/62 |
| 3,262,485 | 7/1966 | Page et al. | 431/90 |
| 3,609,073 | 9/1971 | Robinson | 431/116 |
| 3,732,057 | 5/1973 | Lipper et al. | 431/62 |
| 3,741,166 | 6/1973 | Bailey | 431/116 |
| 3,741,710 | 6/1973 | Nelson | 431/90 |
| 4,004,875 | 1/1977 | Zink et al. | 431/116 |

FOREIGN PATENT DOCUMENTS

| | | | |
|---|---|---|---|
| 439867 | 3/1934 | United Kingdom | 431/62 |
| 819977 | 9/1959 | United Kingdom | 431/116 |

*Primary Examiner*—Samuel Scott
*Assistant Examiner*—Lee E. Barrett
*Attorney, Agent, or Firm*—Salter & Michaelson

[57] ABSTRACT

A blue-flame oil burner including a flame-tube, a wall extending transversely of the flame-tube and defining the upstream end thereof, the wall having therein a metering orifice through which air enters the flame-tube, the orifice being the only air inlet into the flame-tube, an oil atomizing nozzle positioned upstream of the wall and discharging an oil spray through the orifice into the flame-tube, and a mixing tube positioned within the flame-tube co-axially of the orifice and having its upstream end spaced axially from the wall by a distance such that the peripheral area of the space between the wall and the upstream end of the mixing tube and defined within an imaginary upstream extension of the peripheral wall of the mixing tube to the transverse wall is between one and three times the difference between the cross-sectional area at the upstream end of the mixing tube and that at the orifice, the mixing tube having a length, L, and a diameter, D, such that the ratio L/D is between 1.0 and 1.75, and the flame tube having an equivalent ratio L/D of between 2.0 and 5.0.

6 Claims, 1 Drawing Figure

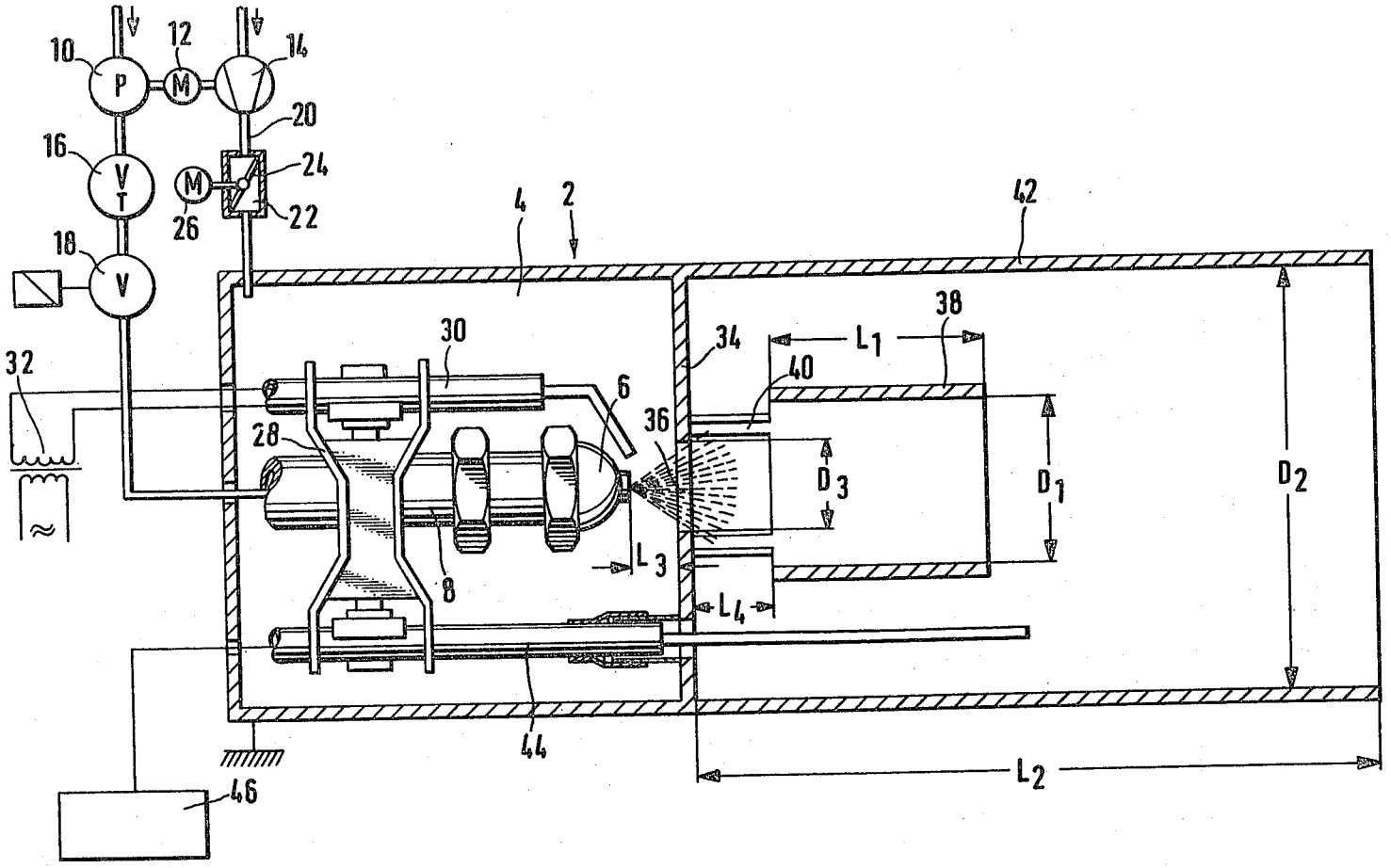
D2
D1
L2
42
38
L1
D3
40
34
L4
36
L3
6
2
4
44
30
8
28
14
20
24
22
12
M
26
P
V
T
V
10
16
18
32
46

BLUE-FLAME OIL BURNER

This is a continuation of application Ser. No. 859,716 filed Dec. 12, 1977, now abandoned.

The invention concerns a blue-flame oil burner, that is an oil burner intended to operate with a blue flame and having provision for recirculation of part of the combustion gases and having an oil-atomising device, a wall containing a metering orifice arranged downstream of the outlet of the oil-atomising device, a mixing tube arranged at a distance downstream of the orifice and coaxial with it and a flame-tube around the mixing tube.

Blue-flame oil burners require that the oil reaching the point of combustion is completely vaporised before it reaches that point. The operation of an oil burner with a blue flame has the advantage that the burner is able to operate with very small excess of air over that required for complete combustion so that practically stoichiometric combustion takes place. Since combustion takes place with very small excess of air a very hot flame is produced which utilises the energy content of the fuel optimally and leads to improved heat transfer. In addition, the waste gases in comparison with waste gases from an optimally adjusted burner with a yellow flame contain extremely little harmful material (soot, $NO_x$, $SO_3$).

Because of the known advantages of an oil burner in which oil is burnt in the vaporised state with a blue flame, there have been no lack of attempts to bring oil burners with blue flames on to the market.

In a known blue-flame type of oil burner an orifice plate is arranged in a double-walled combustion chamber downstream of the oil nozzle. Oil is sprayed through the orifice plate into an elongate mixing tube and, with the aid of air which enters the tube simultaneously through the orifice, partial combustion takes place with an excess of combustible material. These combustion gases are returned and again enter the end of the mixing or vaporisation tube opposite the orifice plate at the same time as the spray of fuel. In this known burner the inner wall is provided with holes through which the greater part of the air of combustion enters in the form of a secondary air flow. (Proc. World Petr. Congr., 7th Volume 7, Sect. on Application and New Uses, Part 1, p 119 ff).

An oil burner with a blue flame with recirculation is also known in which the orifice plate is situated in a tube which extends so far in the upstream direction that the nozzle and the nozzle support are situated completely within the tube. With such a burner the flame should burn immediately behind the orifice plate and part of the combustion gas should be recirculated through an annular space between the tube and an outer tube (ibid.).

An oil burner is also known in which oil is sprayed directly into a tube which is surrounded by an outer recirculation tube connected to the inner tube by means of bores (German Federal Republic Patent Specification No. 1,064,188).

It is an object of the invention to design a blue-flame oil burner incorporating features of advanced conventional technology and which has a high operating reilability.

This object is solved according to the invention by the provision of an oil burner of the kind in which vaporised fuel is capable of burning with a blue flame and having provision for recirculation of part of the combustion gases within a flame tube, the oil burner comprising the flame tube, a wall extending transversely of the flame-tube and defining the upstream end thereof, the wall having therein a metering orifice through which air enters the flame-tube, the orifice being the only air inlet into the flame tube, an oil atomising device positioned upstream of the wall and arranged to discharge an oil spray through the orifice into the flame-tube, and a mixing tube positioned within the flame-tube co-axially of the orifice and having its upstream end spaced axially from the wall by a distance such that the peripheral area of the space between the wall and the upstream end of the mixing tube and defined within an imaginary upstream extension of the peripheral wall of the mixing tube to the transverse wall is between one and three times the difference in cross-sectional area between the upstream end of the mixing tube and the orifice, the mixing tube having a length, L, and a diameter, D, where the mixing tube is of circular cross-section, or where it is not of uniform circular cross-section, a cross-sectional area at the upstream end thereof equal to the area of a circle having a diameter, D, such that the ratio L/D is between 1.0 and 1.75, and the flame tube having an equivalent ratio L/D of between 2.0 and 5.0.

The ratio L/D of the mixing tube is equal to or is approximately 1.5.

The ratio L/D of the flame tube is between 2.5 and 3.0.

The cross-sectional area of the mixing tube is between 1.5 and 3.0 times the cross-sectional area of the orifice.

The flame tube and the mixing tube may have constant cross-section over their length. For example, the flame tube and the mixing tube may both be designed to be cylindrical.

It may, of course, be convenient for silencing to design the flame tube with a cross-section of varying form, for example with a conical enlargement or even in a star shape.

A special problem with blue-flame oil burners is the reliable ignition of the flame in the variable starting conditions which occur in practice, for example relighting a burner which is still hot. According to a feature of the invention the necessary reliability of ignition is achieved in that the burner is started with an air pressure below that of the full-load operation. The supply of air is then quickly increased after the opening of the oil valve to an air fraction slightly above the stoichiometric ratio with which the oil burner is then supplied.

Operation in the manner described is preferably achieved in that the air flap of the blower is provided with a drive and that time switch means are provided for operation of the drive. For example, an electric or hydraulic motor may be provided as the drive which is preferably connected to the air flap through a self-locking gear mechanism.

It is also possible to use an electrically excited magnetic device or a hydraulic cylinder in each case with time-controlling damping members.

It may also be convenient when starting-up either in conjunction with or instead of throttling the air supply to the burner to operate with a throttled flow of oil mixture which can then be quickly brought up to the full air-oil mixture flow.

By way of example an embodiment of the invention is illustrated in the accompanying drawing and is described in detail in the following with reference to the drawing, which shows a longitudinal section through an oil burner according to the invention together with its control and supply devices.

The burner 2 illustrated includes a chamber 4 in which a pressure atomising nozzle 6 is mounted in a known manner at the end of an oil supply pipe 8. Oil is fed into the pipe 8 by an oil pump 10 which is driven by a motor 12 which also drives a blower rotor 14 in a known manner. The pump 10 delivers oil through a hand-operated throttle valve 16 and an electromagnetically-operated shut-off valve 18 into the oil pipe 8 which carries the atomising nozzle 6. The blower 14 delivers air through a duct 20 into the housing 4 through a throttle valve 22 having air flap 24 which can be adjusted by a motor 26. A pair of ignition electrodes 30 is carried by a support 28 mounted on the oil pipe 8 and is connected to an ignition transformer 32.

At a distance $L_3$ from the mouth of the pressure atomising nozzle 6 there is a wall 34 having a metering orifice 36 therein coaxial with the nozzle. At a distance from the orifice 36 there is a mixing tube 38 which is attached to the wall 34 by mounting rods 40. The mixing tube 38 is situated inside an outer tube 42 which forms the flame-tube. In this example, the orifice 36, the mixing tube 38 and the flame-tube 42 are circular but they need not be.

The diameter $D_3$ of the orifice 36 and the arrangement and dimensions of the mixing tube 38 and of the flame-tube 42 are in a predetermined critical relationship to each other which will be discussed in detail in the following.

The atomising nozzle 6 should be adjustable in the axial direction in order to vary the through-put of air and the oil cloud input and thus make it possible to achieve the optimum composition of the mixture.

The diameter $D_3$ of the orifice 36 should be chosen in such a way that at a delivery pressure of the blast 14 which corresponds to the delivery pressure normal in commercial oil burners, the air flow through the orifice 36 in the wall 34 has a predetermined velocity, the orifice being the only passage for combustion air.

The diameter $D_1$ of the mixing tube 38 is at least 1.25 and at maximum 1.7, and is preferably 1.4 to 1.45, times the diameter $D_3$ of the orifice 36. Alternatively, the ratio of the cross-sectional area of the mixing tube and the orifice is between 1.5 and 3.0 and this is also the requirement where the mixing tube and/or the orifice are not of circular cross-section. The length $L_1$ of the mixing tube is between 1.75 and 1.0 $D_1$ where $D_1$ is the diameter of the mixing tube, and preferably $L_1 = 1.5D_1$.

The distance $L_4$ of the mixing tube 38 from the wall 34 is chosen in such a way that a flow cross-section, radially of the mixing tube 38, which is at least 1 to 3 times the difference between the cross-sections of the orifice 36 and of the mixing tube 38 is produced between the upstream end of the mixing tube 38 and the wall 34. In other words, the peripheral area of the space between the wall 34 and the upstream end of the mixing tube 38 and defined within an imaginary upstream extension of the peripheral wall of the mixing tube 38 to the wall 34 is between one and three times the difference in cross-sectional area between the upstream end of the mixing tube 38 and the orifice 36. The diameter $D_2$ of the flame tube 42 is approximately twice to 2.5 times the diameter $D_1$ of the mixing tube and the ratio of the length $L_2$ to the diameter $D_2$ of the flame tube is between 2:1 and 5:1 and is preferably between 2.5:1 and 3:1.

A spray cone of approximately 60 to 80 degrees is convenient for the pressure atomising nozzle 6. Particularly good results were obtained with nozzles with hollow spray cones. When the oil burner is to be started, the motor 12 is first switched on in the normal way. At the same time, the throttle flap 24 is closed unless it had already been closed during shutting off of the oil burner. A short time later voltage is applied to the ignition electrodes 30 and the electro-magnetically operable valve 18 is subsequently opened so that oil supplied by the oil pump 10 reaches the pressure atomising nozzle 6. At the same time, air is supplied by means of the blast 14 to the chamber 4. The mixture produced is ignited by the ignition electrodes 30. A flame is thereby produced in that part of the flame tube 42 situated in front of the downstream end of the mixing tube 38. At the same time that ignition occurs, the throttle flap 24 is moved into the operating position under the control of control apparatus. The diameter of the orifice 36 is such that the air inside the mixing tube 38 has a velocity such that drops of atomised oil do not form on the inner wall of the mixing tube 38 when the air throttle flap is open. By means of the core stream of air, oxygen-poor combustion gas is sucked through the annular space around the mixing tube 38 and through the upstream end of the mixing tube 38 or through openings in the rear wall of the mixing tube at its upstream end. These hot combustion gases surround the core stream and give up heat thereto. An additional criterion for the dimension of the orifice 36 and the air velocity is that the air velocity in the mixing tube 38 should be greater than the velocity of propagation of the flame in order to ensure that the flame burns at a distance from the downstream end of the mixing tube 38. The stated operating conditions give the result that the distance between the end of the mixing tube 38 adjacent the wall 34 and said wall 34 is small as possible. This distance must be chosen in such a way that the recirculating gases flowing into the mixing tube 38 are as loss-free as possible and are able to mix with the oil cloud/air mixture of the core stream for the purpose of heat exchange. With experimental burners the following dimensions have been found to be favourable:

1. Using a pressure atomising nozzle giving a throughput of 0.5 to 0.65 gal/hr and

| | |
|---|---|
| Diameter of the orifice $D_3$ | 23.5–26 mm |
| Internal diameter of the mixing tube $D_1$ | 35 mm |
| Internal diameter of the flame-tube $D_2$ | 76 mm |

a very stable flue flame was produced over the whole range of throughput.

2. Using a pressure atomising nozzle giving a throughput of 0.65 to 0.9 gal/hr, the diameter $D_3$ of the orifice 36 was increased to 25–31 mm with the remaining dimensions kept constant. Once again a stable blue flame was produced over the whole range of throughput.

A series of models developed for fabrication had the following principal dimensions (all measurements in mm):

| Model | $D_1$ | $D_2$ | $D_3$ | $L_1$ | $L_2$ | $L_4$ | Nozzle 60° H gal/hr |
|---|---|---|---|---|---|---|---|
| 1 | 36 | 77 | 23.5 | 57 | 225 | 9 | 0.5 |
| 2 | 36 | 77 | 26 | 57 | 225 | 9 | 0.65 |

-continued

| Model | $D_1$ | $D_2$ | $D_3$ | $L_1$ | $L_2$ | $L_4$ | Nozzle 60° H gal/hr |
|---|---|---|---|---|---|---|---|
| 3 | 36 | 77 | 29 | 52 | 225 | 14 | 0.75 |

In all the models the distance $L_3$ of the nozzle opening from the front face of the wall 34 was 2 mm.

Maintenance of the following combustion data was established for all models on the test bench:

| | |
|---|---|
| $CO_2$ = | 15% (approximate theoretical maximum) |
| Soot = | 0 |
| CO = | 0.01% |

With blue flames, monitoring of the flame cannot be carried out optically. To guarantee a reliable automatic operation of the blue-burning flame monitoring is possible by means of an ionisation detector 44 which is connected in known manner to a control device 46 by means of which, when the flame is extinguished, the supply of oil is cut off by closing the valve 18 and the motor 12 is switched off. After the flame has been produced the ignition device is also switched off by the control device in known manner.

It has been shown in practice that it is essential that the mixing tube 38 should be designed with as small a volume as possible, and thus, for giving dimensions, with as small a wall thickness as possible. This ensures that the mixing tube 38 will glow bright red, so that a large portion of the heat of the recirculating combustion gases is transferred to the mixture of air and oil drops in the form of radiant heat, so that, once again, the complete vaporisation of the oil without droplets impinging on hot surfaces is ensured. With the aforesaid ratio $L_1$:$D_1$ for the mixing tube it is ensured that the mixing tube is surrounded over its whole length by oxygen-poor combustion gases so that with mixing tubes of heat resistant steel it is not possible for any marked scaling or oxidation of the mixing tube to occur. The mixing tube may also be made from heat resistant ceramic material. The support of the mixing tube 38 can be effected, instead of by the axial arms 40, by radial arms which should then be mounted on the inside of the flame tube 42.

With stoichiometric combustion in the flame tube 42 practically no free oxygen is present. This is another reason why the flame tube 42 may be made of heat resistant steel without risk of wear due to scaling or oxidation. Alternatively, the flame tube 42 may be made from a heat resistant ceramic material or a steel tube having a heat resistant ceramic coating may be used. It is possible to arrange for the flame tube to be cooled, for example, the heating water. In this case the flame tube may, for example, form part of the heat exchange system of the boiler. With cooled flame tubes, it is not necessary to use hightly heat resistant materials.

Combustion in the oil burner described is to a large extent independent of the size and shape of the combustion chamber of the boiler. Under very unfavourable conditions, resonance phenomena may, however, occur during the ignition phase. These can be prevented by providing the wall of the flame tube 42 with a few holes in the region of the flame front. The development of noise may also be caused by a change in the flame cross-section. For example to reduce noise, a conical expansion of the flame-tube may be provided or the flame-tube, downstream of the flame zone, may be given a star-shaped cross-section.

A special problem with oil burners burning with a blue flame is that of guaranteeing reliable ignition under all working conditions. According to a feature of the invention, reliable ignition is achieved by, at the moment of ignition, supplying the burner with less than the stoichiometric air quantity required relative to the nominal load. For this purpose the air flap 24 of the throttle valve 22 is moved to a suitable starting position by the adjusting motor so that on fresh ignition only, a suitably adjusted less than stoichiometric air quantity is supplied to the chamber 4. After the oil has ignited, the air flap 24 is moved by the adjusting motor 26 into the open position in which the quantity of air required for stoichiometric combustion is allowed to pass through the valve 22. The adjusting motor 26 may be switched on at the same time that the electro-magnetically-operable valve 18 is opened, a finite time delay necessary being produced by means of a step-down gearing and, if necessary, accessory electrical control elements. This method of operation has the advantage that the air quantity is increased continuously. Switching on of the motor may also occur in dependence of the detection of a flame by means of the ionisation indicator 44. As the drive for the air flap, it would also be possible to provide an electro-magnetic device with known means of delay. A delay could be ensured for both an electro-magnetic device and an adjusting motor by means of a semi-conducting resistor. It has been established that, in general, in order to achieve reliable ignition, it is sufficient to start the burner with less than stoichiometric air quantity for a duration of about 3 to 5 seconds. It has been established that with this time, a stable recirculation flow is achieved with simultaneous heating of the mixing tube to the operating temperature. During starting with less than the stoichiometric air quantity, as described, no formation of soot was observed. Probably the reason for this is that the amount of air present at any time within the combustion chamber of the boiler is sufficient to ensure that the necessary oxygen for complete combustion is available. Depending on the conditions in the boiler at a particular time it may be necessary to increase the time allowed before the complete opening of the throttle flap occurs to 6 to 10 seconds.

From a general point of view it is important for reliable ignition, to start the burner with an air velocity less than the air velocity at full load. Conveniently, it has been shown that during starting an excess pressure of 23 to 25 mm head of water during full air-fuel mixture flow.

If a hydraulically-operated adjusting motor is used, it is possible to employ the heating oil compressed by the pump 10 as the pressure fluid. Under certain circumstances it may also be convenient to provide means by which it is possible to start the burner with, in addition to the throttling of the air stream, a throttled stream of oil as well. Then the stream of oil is raised to full flow in the same time period as that stated hereinbefore for the air stream. It is possible in this case, to keep the period of the less than stoichiometric operation short during starting and in the ideal case to maintain stoichiometric conditions of combustion even during starting the burner. It is, a necessary condition that even with a decreased flow of oil, the atomisation of the oil is not impaired. Up to a certain size, larger oil drops are acceptable since the walls, in particular the wall of the mixing tube, the temperature of which is essentially equal to the temperature of the boiler water (about 70°–90° C.) during the starting process, have a certain storage capacity, that is to say larger drops of oil can settle on the walls at first and form an oil film there which will evaporate once full air-fuel mixture flow has been achieved.

In order to be able to operate the burner with maximum air-fuel mixture flow under varying conditions with as constant an excess of air as possible, that is as accurately stoichiometrically as possible, it is convenient to provide means by which it is possible to adjust the flow rates of air and/or oil automatically in response to momentary changes in operational conditions, in particular air pressure, air temperature and/or the boilder draught.

With pressure atomising nozzles having a high throughput, the fine atomisation necessary for vaporisation is often no longer achievable. For burners of high power it may therefore be convenient to arrange a plurality (at least two) of nozzles at a distance from one another, either parallel or at an angle to each other, where the cross-section of the orifice 36 in the wall 34, the mixing tube 38 and, where necessary, the flame-tube 42 are geometrically adapted in a suitable manner.

The orifice 36 may, as illustrated, be a simple stamped-out opening in a disc-shaped wall 34. The orifice 36 may, however, be formed so as to project for a short distance in the form of a tube with an angular or a rounded-off transition to the wall 34.

What I claim as my invention and desire to secure by Letters Patent of the United States is:

1. An apparatus for burning oil and combustion air under relatively high pressure for producing a high-heat blue flame, comprising a burner having a chamber in which an oil atomizing device is located, means for introducing pressurized combustion air into said chamber for surrounding said oil atomizing device, an interior wall spaced from said oil atomizing device downstream therefrom, orifice means formed in said interior wall and communicating with said oil atomizing device, said oil atomizing device injecting oil under pressure therefrom for mixing with said combustion air, a flame tube joined to said interior wall in coaxial relation with respect to said oil atomizing device and defining the downstream portion of said burner, a mixing tube located interiorly of and coaxially with respect to said oil atomizing device and said flame tube and said orifice means and being disposed downstream of said orifice means and spaced from said interior wall, the area in said flame tube that is located downstream of the downstream end of said mixing tube and that is spaced inwardly of the discharge end of said flame tube defining a combustion zone which is the region of highest temperature in said flame tube, said mixing tube having opening means formed in the upstream end thereof, wherein the space between said interior wall and the upstream end of said mixing tube provides for reentry into said upstream end of a portion of the combustion gases that are discharged from the downstream end of said mixing tube for recirculation thereof, said recirculated combustion gases being those gases in which the oil has not been completely oxidized, said recirculated gases being drawn from the combustion zone toward the upstream end of said mixing tube by the velocity of the mixed atomized oil and combustion air passing into said mixing tube from said orifice means, the recirculated combustion gases providing for heating of the mixture of air and atomized oil entering the mixing tube from said orifice means whereby the atomized oil is vaporized, the upstream end of said flame tube being sealingly connected to said interior wall in which said orifice means is located, a freely open annular space being formed between the outer surface of said mixing tube and the inner surface of said flame tube, recirculation of the combustion gases occurring over substantially the entire length of said flame tube from said combustion zone to said mixing tube, the path of said recirculated combustion gases that emanate from the region of highest temperature in said flame tube being directed through said annular space into the upstream end of said mixing tube, the wall of said flame tube being relatively thin, wherein the freely open annular space as defined between said flame tube and said mixing tube is of sufficient dimension to provide for the free flow of said recirculating combustion gases therethrough to said mixing tube, said mixing tube having a ratio of length ($L_1$) to diameter ($D_1$) of between about 1.0 and 1.75, said flame tube having a ratio length ($L_2$) to diameter ($D_2$) of between about 2.0 and 5.0 and said flame tube being a diameter ($D_2$) which is about 2–2.5 times the diameter ($D_1$) of said mixing tube.

2. An apparatus as claimed in claim 1, an air duct for supplying air to said combustion air supply, a valve having an air flap located in said air duct, said air flap having a drive, time switch means for operating said drive, wherein said air flap is movable into a throttling position before ignition of the air-fuel mixture, during which only an under-stoichiometric share of air is supplied to said apparatus.

3. An apparatus as claimed in claim 1, the inlet diameter of the space between the upstream end of said mixing tube and said wall being approximately 2 or 3 times the difference of diameter of said mixing tube and orifice means.

4. An apparatus as claimed in claim 1, said mixing tube having a circular cross-sectional configuration.

5. An apparatus as claimed in claim 1, the length ($L_1$) of the mixing tube being equal to or less than $1\frac{1}{2}$ times the diameter ($D_1$) thereof.

6. An apparatus as claimed in claim 1, the wall of said flame tube being provided with a plurality of holes in the region of the combustion zone.

* * * * *